United States Patent [19]

Eli, Jr.

[11] 4,141,459

[45] Feb. 27, 1979

[54] PROTECTING DEVICE FOR CONTAINERS

[76] Inventor: John C. Eli, Jr., 1476 Smiley Heights Dr., Redlands, Calif. 92373

[21] Appl. No.: 864,526

[22] Filed: Dec. 27, 1977

[51] Int. Cl.[2] ..... B65D 25/00; B65D 7/42

[52] U.S. Cl. ..... 220/85 K; 220/73; 220/69; 138/96 R

[58] Field of Search ..... 220/85 K, 69, 73, 4 A, 220/90.2, 90.4, 90.6, 355, 309; 138/96 R

[56] References Cited

U.S. PATENT DOCUMENTS

| | | | |
|---|---|---|---|
| 505,364 | 9/1893 | MacIntosh | 220/4 A |
| 674,305 | 5/1901 | Patterson | 220/309 |
| 891,895 | 6/1908 | Young | 220/73 |
| 1,303,153 | 5/1919 | Bennett | 220/73 |
| 2,801,039 | 7/1957 | Arneson | 220/69 X |
| 3,307,766 | 3/1967 | Angstadt | 220/73 X |
| 3,963,226 | 6/1976 | Jankowski, Jr. | 220/85 K X |
| 3,977,563 | 8/1976 | Holt | 220/355 X |

FOREIGN PATENT DOCUMENTS

| | | | |
|---|---|---|---|
| 468711 | 7/1937 | United Kingdom | 220/85 K |

*Primary Examiner*—William Price
*Assistant Examiner*—Steven M. Pollard
*Attorney, Agent, or Firm*—Harvey S. Hertz

[57] ABSTRACT

A strip of reinforcing material having a reverse bend section along one side edge is bendable to be wrapped around the rim of a container, such as a garbage or trash container. The reverse bend section forms a groove to receive the container rim and the remainder of the strip forms a protective and reinforcing skirt to prevent damage to adjacent portions of the container and to reduce noise incurred in handling the container.

9 Claims, 11 Drawing Figures

FIG. 1.
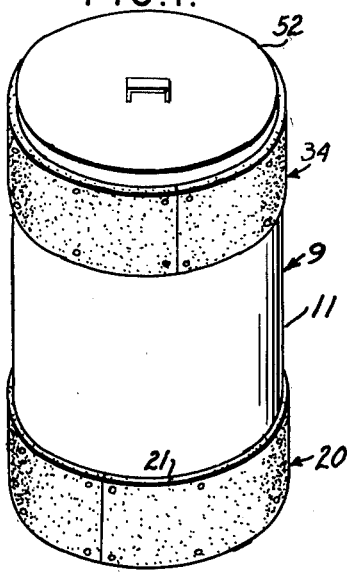
FIG. 8.
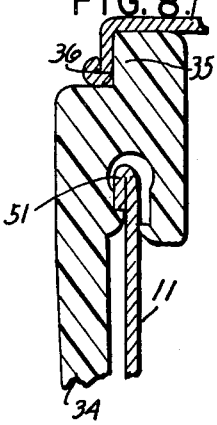
FIG. 2.
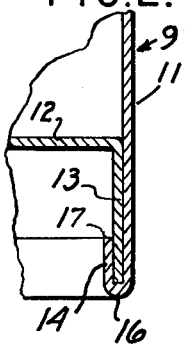
FIG. 3.
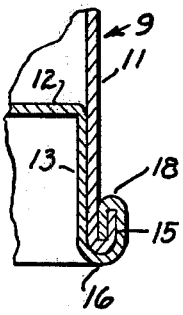
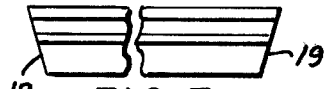
FIG. 7.
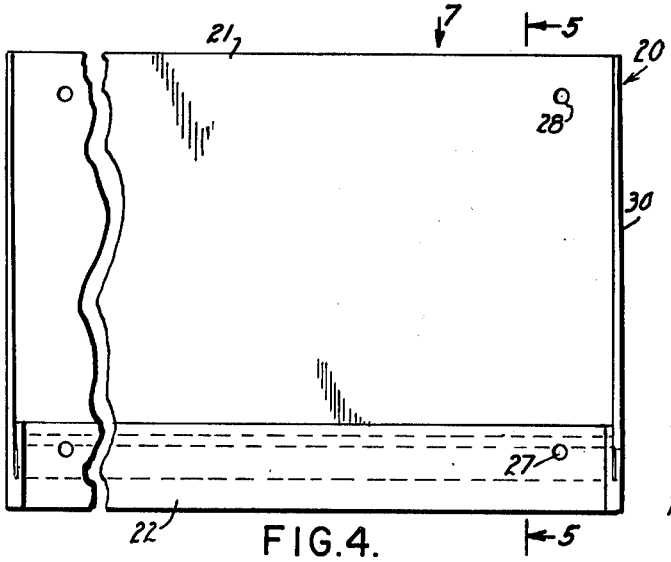
FIG. 4.
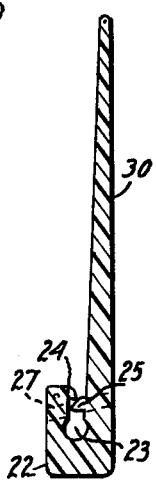
FIG. 5.
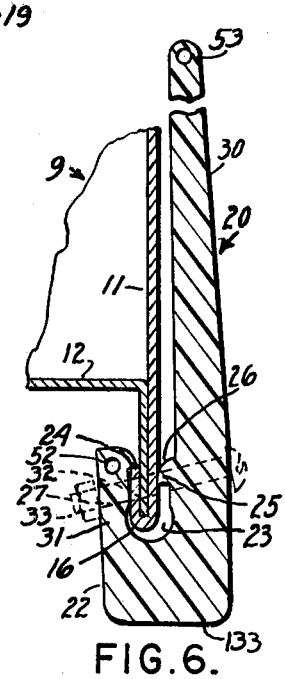
FIG. 6.
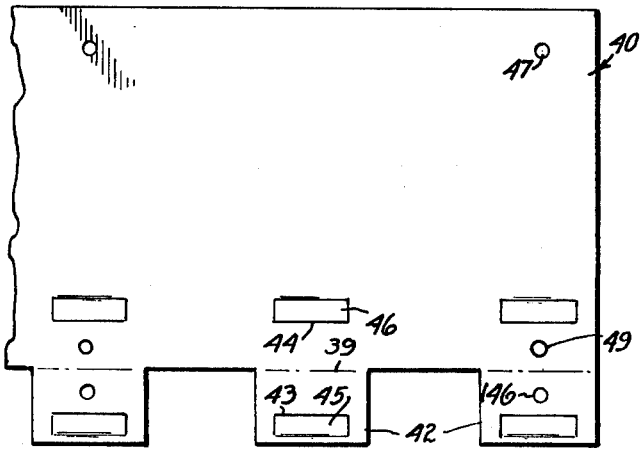
FIG. 9.
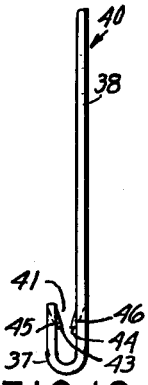
FIG. 10.
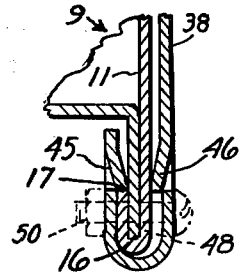
FIG. 11.

PROTECTING DEVICE FOR CONTAINERS

BACKGROUND OF THE INVENTION

1. Field of the Invention

This invention relates to containers, such as containers for garbage, trash, chemicals, liquids and the like, and has particular reference to means for protecting such containers against damage, and for reducing noise pollution resulting from handling such containers.

2. Description of the Prior Art

Containers, particularly those on the order of 25-gallon capacity and over, are usually made of sheet metal and, because of their relatively high cost, are often reused. Particularly when filled, such containers are heavy and are subject to physical abuse in handling and shipping, resulting in heavy crumpling and denting. This not only shortens the life of the container; but, in the case of containers for liquids, or comminuted solids, such damage often causes leaks in the container seams, which render the container unfit for reuse. Additionally, unsightly denting, etc., resulting from such physical abuse may detract from the appearance of the container. Further, metal containers or metal-edged containers tend to create a considerable amount of undesirable noise when being handled.

SUMMARY OF THE INVENTION

The principal object of the present invention is to reinforce and protect a container of the above type against damage thereto.

Another object is to provide a reinforcing and protecting device for containers of the above type which may be readily formed to fit containers of different sizes.

Another object is to provide a reinforcing and protecting device for a container of the above type which also reduces noise produced in handling such container.

A further object is to provide a reinforcing and protecting device for a container of the above type which is simple and inexpensive to manufacture.

According to the present invention, a container protecting and reinforcing device is provided having an elongate strip of preferably tough, yieldable material, such as plastic or elastomeric material, having a reverse bend section formed along one side edge which forms a groove to receive the rim of a container. The remainder of the strip forms a protective skirt which surrounds the adjacent portion of the container to protect the same against damage. Locking shoulders project into the groove to lock against a portion of the container rim. Thus, the device protects and reinforces both the sides and end of the container. The skirt could, if desired, extend the length of the container. The reinforcing device, further, reduces noise produced in handling the container.

BRIEF DESCRIPTION OF THE DRAWING

The manner in which the above and other objects of the invention are accomplished will be readily understood on reference to the following specification when read in conjunction with the accompanying drawings, wherein:

FIG. 1 is a perspective view of a container, such as a trash container, illustrating protecting devices, embodying a preferred form of the present invention, mounted at opposite ends.

FIG. 2 is a fragmentary sectional view through a conventional container of one typical form.

FIG. 3 is a fragmentary sectional view through a conventional container of another typical form.

FIG. 4 is a front view, partly broken away, of a protecting device comprising a preferred embodiment and showing the same in a flat configuration.

FIG. 5 is a transverse sectional view through the protecting device and is taken along line 5—5 of FIG. 4.

FIG. 6 is an enlarged sectional view, similar to that of FIG. 5, but illustrating the device attached to the lower rim of a container.

FIG. 7 is a fragmentary plan view of the protecting device and is taken in the direction of the arrow 7 in FIG. 4.

FIG. 8 is an enlarged fragmentary sectional view through a device of the present invention showing the same attached to the upper edge of the container of FIG. 1.

FIG. 9 is a front developed view of part of a protecting and reinforcing device comprising a modified form of the invention.

FIG. 10 is an edge view of the device of FIG. 9, showing the same after the locking section has been formed.

FIG. 11 is an enlarged fragmentary sectional view of the device illustrated in FIG. 8, showing the same attached to the lower rim of a container.

DESCRIPTION OF THE PREFERRED EMBODIMENT

Referring first to FIGS. 2 and 3, it will be noted that containers 9 of the above noted type, such as garbage containers, usually have cylindrical sides 11 formed of sheet metal and have enclosures or bulkheads 12 provided at least at one end of the container. Such bulkhead 12 is generally formed of sheet metal having a cylindrical flange 13 which fits within the side 11 of the container to form a rim portion. In the form exemplified in FIG. 2, the outer edge of the side 11 is turned inwardly over the edge of the bulkhead flange 13, as indicated at 14. In the form exemplified in FIG. 3, the edges of the bulkhead flange 13 and the container side 11 are turned outwardly upon themselves as indicated at 15. In either case, a reinforcing rim 16 results. Obviously, such reinforcing rim 16 may be formed in other manners, but such rim 16 generally leaves either a ledge 17 extending around the inside of the container (FIG. 2) or a similar ledge 18, extending around the outside of the container (FIG. 3). Other containers, not shown, may be formed with sides of a material other than sheet metal and may have bulkheads attached thereto in a manner somewhat similar to those indicated in FIGS. 2 and 3, but generally, all such containers have a rim portion projecting outwardly from the bulkhead.

Referring now to FIGS. 1 and 4 to 8, inclusive, the reinforcing device of the present invention is generally indicated at 20 and comprises an elongate strip 21 of suitable damage resistant material, such as plastic, elastomeric material, or metal. The strip 21 is preferably in a flat condition initially to facilitate shipping and is preferably of such length as to extend around the periphery of the container, although it may be initially longer and subsequently cut to the proper length for the chosen container. In fact, it may be made of any desired length, width and thickness. Also, the strip could be cast in cylindrical shape.

In cases where the strip is initially provided in flat condition, the ends are preferably cut at an obtuse angle to the length of the strip, as shown at 19, FIG. 7, so that, when the strip is subsequently bent into a cylindrical shape, the ends will properly fit together.

The strip 21 has a reverse bend section 22 which is U-shaped in cross section, extending along the length thereof and forming a groove 23 adapted to receive the rim 16 of a container 9, as seen in FIG. 6. The remaining section 30 of the strip 21 forms a protective skirt for enclosing the adjacent portion of the container side. Such skirt tapers in cross section toward the upper side edge of the strip.

Two inwardly facing locking shoulders 24 and 25 are formed along the length of the section 22 to extend into the groove 23 from opposite sides. It will be noted that the shoulder 24 is spaced further from the bottom of the groove 23 than is the shoulder 25 so that it may initially overlap the latter shoulder before assembly of the srip onto the rim 16 of the container. The upper edges of the shoulders 24 and 25 are rounded, as indicated at 26, to facilitate entry of the container rim 16 endwise into the groove 23 after the strip 21 has been wrapped around the container 9.

Mounting holes 27 and 28 are formed in reverse bend section 22 and in the skirt section 30, respectively, at spaced points along the length of the strip 21 for possible attachment purposes, as will be described presently.

In mounting the reinforcing strip 21 on the container, it is first wrapped around the container and is then forced endwise, causing the container rim 16 to enter the groove 23 and causing the inner leg 31 of the reverse bend section 22 to yield inwardly until one or the other of the locking shoulders 24 and 25 snaps over a ledge, i.e. ledge 17, of the container rim 16 to lock the device 20 in place. If the ledge were on the outside of the container, as exemplified by the construction shown in FIG. 3, the shoulder 25 would latch over such ledge, thereby also locking the strip in position.

In order to more permanently attach the device 20 to the container 11, holes, i.e. 32, may be drilled in the rim 16 and in the side of the container in alignment with holes 27 and 28, and screws or other fasteners indicated by dotted lines 33 may be mounted in the aligned holes to clamp the strip 21 in place on the container.

As an alternative means for permanently attaching the reinforcing device 20 to the container, holes 52 and 53 may be formed lengthwise through the strip 21 to receive split ring spring members, not shown. The spring member in the upper hole 53 would be stressed radially inward to yieldably clamp the skirt 30 against the container side, whereas the spring member in the lower hole 52 would be stressed radially outward to yieldably force the leg 31 of section 22 outwardly against the container rim 16. Alternatively, a wire, not shown, could be passed through the upper hole 53 and its ends twisted or otherwise secured together to clamp the skirt 30 against the container side.

It will be noted that the reverse bend section 22 presents a relatively wide rim portion 133 on which the container may rest to protect the relatively narrow rim 16.

When the strip is made of tough yieldable material, such as plastic or rubber, it tends to absorb any shocks during handling and shipping and consequently reduces any noise incurred in handling the container.

As shown in FIGS. 1 and 8, a second similar protecting and reinforcing device 34 may be similarly constructed and mounted on the upper open end of the container 11. In this case, a ridge 35 is integrally formed along the length of the device 34. The ridge has its outer edge 36 located so that when the device 34 is attached to the upper rim 51 of the container 11, the edge 36 will be aligned with the outer edge of the rim 51 of the container so that a cover 52 originally intended to be snugly fitted over the container rim 51 can now be fitted snugly over the reinforcing device 34.

DESCRIPTION OF A MODIFIED EMBODIMENT

Referring to FIGS. 9, 10 and 11, a modified form of the invention is shown comprising a strip 40 which is basically similar to that shown in FIGS. 1 and 4 to 8, except that it is formed of a bendable sheet material, such as sheet metal, and comprises a reverse bend section 37 and an integral skirt section 38. The reverse bend section 37 is formed along the lower side edge of the strip 40 and initially assumes the shape seen in FIG. 9 wherein spaced projections 42 are formed along the length of the strip. Such projections 42 are bent substantially along a fold line 39 into the shape shown in FIG. 10. Inwardly extending locking shoulders 43 and 44 are provided by shear formed tabs 45 and 46, respectively, to extend into the grooves 41 formed between the bent over projections 42 and the main part of the skirt section 38 to interlock with any ledge, such as, for example, ledge 17, presented by the rim 16 of the container 11. Alternatively, the locking shoulders 43 could be formed by bending the outer edges of the projections 42 back upon themselves.

Holes 146, 49 and 47 are formed in the strip 40 at spaced points along the length thereof. After mounting the strip on the container 11 as shown in FIG. 11, holes 48 may be drilled in the rim 16 of the container in alignment with holes 146 and 49 to receive fastener screws or the like, such a screw being shown by the dotted lines 50. Other holes may be drilled in the strip 40 in alignment with holes 47 to also receive fastener screws or the like to more or less permanently lock the reinforcing device in place. Staples or the like (not shown) could be inserted in the end ones of the holes 146 and 47 to span opposite ends of the formed strip 40.

It will be obvious to those skilled in the art that many variations may be made in the exact construction shown without departing from the spirit or scope of this invention. For example, the reinforcing device may be mounted on containers which are other than cylindrical.

I claim:

1. A reinforcing device for a container having a rim at one end thereof which comprises a yieldable strip forming a reinforcing member adapted to surround said container, said member having a reverse bend section adjacent one side edge thereof, said reverse bend section forming a groove adapted to receive said rim to reinforce said rim, said strip including a pair of locking shoulders extending in facing directions into said groove, one of said locking shoulders interlocking said container rim, and the other of said locking shoulders spacing said container from said reinforcing member; the remainder of said member forming a protective skirt for an adjacent portion of said container.

2. A reinforcing device as defined in claim 1 comprising means for securing said member to said rim.

3. A reinforcing device as defined in claim 1 wherein said reverse bend section and said groove extend along the length of said strip.

4. A reinforcing device as defined in claim 1 wherein said remainder of said member tapers in cross section toward the opposite side edge thereof.

5. A reinforcing device as defined in claim 1 wherein said strip is formed of sheet metal, said strip locking shoulders comprising locking tabs formed from said reverse bend section and extending into said groove whereby to interlock with said rim.

6. A reinforcing device as defined in claim 5 wherein said reverse bend section comprises spaced apart projections along the length of said strip, certain of said locking tabs being formed from said projections.

7. A reinforcing device as defined in claim 1 comprising holes in said reinforcing member, said holes being spaced around said member whereby to receive fasteners for fastening said member to said container.

8. A reinforcing device as defined in claim 1 wherein said member comprises a ledge on the side thereof opposite said skirt for supporting a removable cover for said container.

9. A reinforcing device in accordance with claim 1 wherein said locking shoulders are spaced at different distances from the bottom of said groove for enabling said shoulders to overlap before assembly of the strip onto said rim.

* * * * *